US010119551B2

(12) United States Patent
Kovach et al.

(10) Patent No.: US 10,119,551 B2
(45) Date of Patent: Nov. 6, 2018

(54) ANTI-ICING IMPELLER SPINNER

(71) Applicant: Hamilton Sundstrand Corporation, Charlotte, NC (US)

(72) Inventors: Brandon T. Kovach, Rockford, IL (US); Joseph Wetch, Roscoe, IL (US); Adrian L. Stoicescu, Roscoe, IL (US); Michael F. Cass, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 341 days.

(21) Appl. No.: 14/821,389

(22) Filed: Aug. 7, 2015

(65) Prior Publication Data

US 2017/0037863 A1 Feb. 9, 2017

(51) Int. Cl.

| | |
|---|---|
| ***F04D 29/22*** | (2006.01) |
| ***F02M 59/44*** | (2006.01) |
| ***F04D 29/28*** | (2006.01) |

(52) U.S. Cl.

CPC ..... *F04D 29/2261* (2013.01); *F02M 59/44* (2013.01); *F04D 29/2277* (2013.01); *F04D 29/28* (2013.01)

(58) Field of Classification Search

CPC .. F04D 29/2261; F04D 29/28; F04D 29/2277; F04D 29/266; F04D 3/02; F04D 29/20; F04D 29/044; F02M 59/44; F01D 5/025

See application file for complete search history.

(56) References Cited

U.S. PATENT DOCUMENTS

| | | | | |
|---|---|---|---|---|
| 2,010,525 | A * | 8/1935 | McHugh | F04D 29/20 29/238 |
| 2,349,731 | A * | 5/1944 | Hornschuch | F04D 13/043 415/104 |
| 2,353,431 | A * | 7/1944 | Arden | A63H 27/02 403/260 |
| 2,438,866 | A | 3/1948 | Rockwell et al. | |
| 2,534,662 | A * | 12/1950 | Froom | B64C 11/14 403/306 |
| 3,163,119 | A * | 12/1964 | Hupper | F04D 3/02 415/143 |
| 3,588,266 | A * | 6/1971 | Scott-Scott | F04D 9/00 415/11 |
| 3,612,719 | A | 10/1971 | Nomura | |
| 3,751,178 | A | 8/1973 | Paugh et al. | |
| 3,834,157 | A | 9/1974 | Hoffmann | |

(Continued)

FOREIGN PATENT DOCUMENTS

| | | |
|---|---|---|
| DE | 1944639 U | 8/1966 |
| FR | 1331513 A | 7/1963 |

(Continued)

OTHER PUBLICATIONS

Extended European Search Report for EP Application No. 16182772.0, dated Jan. 5, 2017, 6 pages.

*Primary Examiner* — Eldon Brockman
(74) *Attorney, Agent, or Firm* — Kinney & Lange, P.A.

(57) ABSTRACT

An impeller spinner for a fuel pump can include a head and a shank. The head can have a base at one end and a tip at an opposite end. The shank can have a body portion nearest the head with a first diameter and a fastener portion adjacent to the body portion at an end opposite the head with a second diameter.

11 Claims, 4 Drawing Sheets

(56) References Cited

U.S. PATENT DOCUMENTS 3,904,301 A * 9/1975 Schroeder ..... F04D 29/20 403/259
3,998,048 A 12/1976 Derue
4,019,829 A * 4/1977 Knopfel ..... F04D 29/2277 415/143
4,120,603 A 10/1978 Downing
4,125,344 A * 11/1978 Tiefenbacher ..... F01D 5/045 416/183
4,142,839 A * 3/1979 Davis ..... F04D 29/2277 415/143
4,175,911 A * 11/1979 Tiefenbacher ..... F01D 5/045 416/183
4,393,650 A 7/1983 Pool
4,648,768 A * 3/1987 Hambric ..... B63H 23/34 411/217
4,699,568 A 10/1987 Harlamert et al.
5,061,151 A * 10/1991 Steiger ..... F04D 9/041 415/106
5,427,501 A 6/1995 Chu
5,573,378 A 11/1996 Barcza
6,012,901 A 1/2000 Battig et al.
6,361,270 B1 * 3/2002 Bennett ..... F04D 1/10 415/143
7,470,115 B2 * 12/2008 Meacham ..... F01D 5/025 416/204 A
8,147,208 B2 4/2012 Hagshenas et al.
2004/0067133 A1 * 4/2004 Ishigaki ..... F04D 1/025 415/219.1
2009/0120099 A1 5/2009 Brand et al.

FOREIGN PATENT DOCUMENTS

GB 2039615 A * 8/1980 ..... F04D 29/2277
WO WO02/20349 A1 3/2002
WO WO2015/040376 A1 3/2015

* cited by examiner

ANTI-ICING IMPELLER SPINNER

BACKGROUND

The present invention relates generally to a mechanism for limiting or preventing ice accretion and ingestion in a pump and relates more specifically relates to an impeller spinner for a fuel pump.

Low flow and low temperatures can cause small quantities of water in a liquid fuel to freeze and cause ice accumulation in a fuel system. A stagnation zone or zone of low flow can be present at an inlet of a fuel pump. When the fuel pump is operating at sufficiently low temperatures, the stagnation zone can cause ice accretion and build-up of snowball-like clusters of ice at the inlet. While a small amount of ice can be ingested by the fuel pump, the ingestion of larger snowball-like clusters of ice can block the flow of fuel through the pump. Reduction of the size of the stagnation zone can lower the rate at which ice accretes and is ingested by the fuel pump, thereby limiting or preventing blockage. Anti-icing is of particular importance in the aerospace industry where fuel systems are often operated in low temperatures. However, the problem is not limited to the aerospace industry or to liquid fuels.

SUMMARY

An impeller spinner for a fuel pump can include a head and a shank. The head can have a base at one end and a tip at an opposite end. The shank can have a body portion and a fastener position. The body portion can be nearest the head with a first diameter and the fastener portion can be adjacent to the body portion at an end opposite the head with a second diameter.

An anti-icing apparatus for a fuel pump can include an impeller spinner. The impeller spinner can include a head and a shank. The head can have a base at one end and a tip at an opposite end. The shank can have a body portion and a fastener portion. The body portion can be nearest the base of the head with a first diameter and the fastener portion can be adjacent to the body portion at an end opposite the head with a second diameter. The first diameter of the body portion can be greater than the second diameter of the fastener portion and can be less than a diameter of the base of the head.

A method of reducing ice accretion on an impeller of a centrifugal fuel pump can include the steps of rotating an impeller of the centrifugal fuel pump and deflecting a flow of fuel upstream of the impeller. The flow of fuel can be deflected by a conical structure having a base engaged with the impeller and a pointed tip upstream of the impeller.

The present summary is provided only by way of example, and not limitation. Other aspects of the present disclosure will be appreciated in view of the entirety of the present disclosure, including the entire text, claims and accompanying figures.

Figure 1:
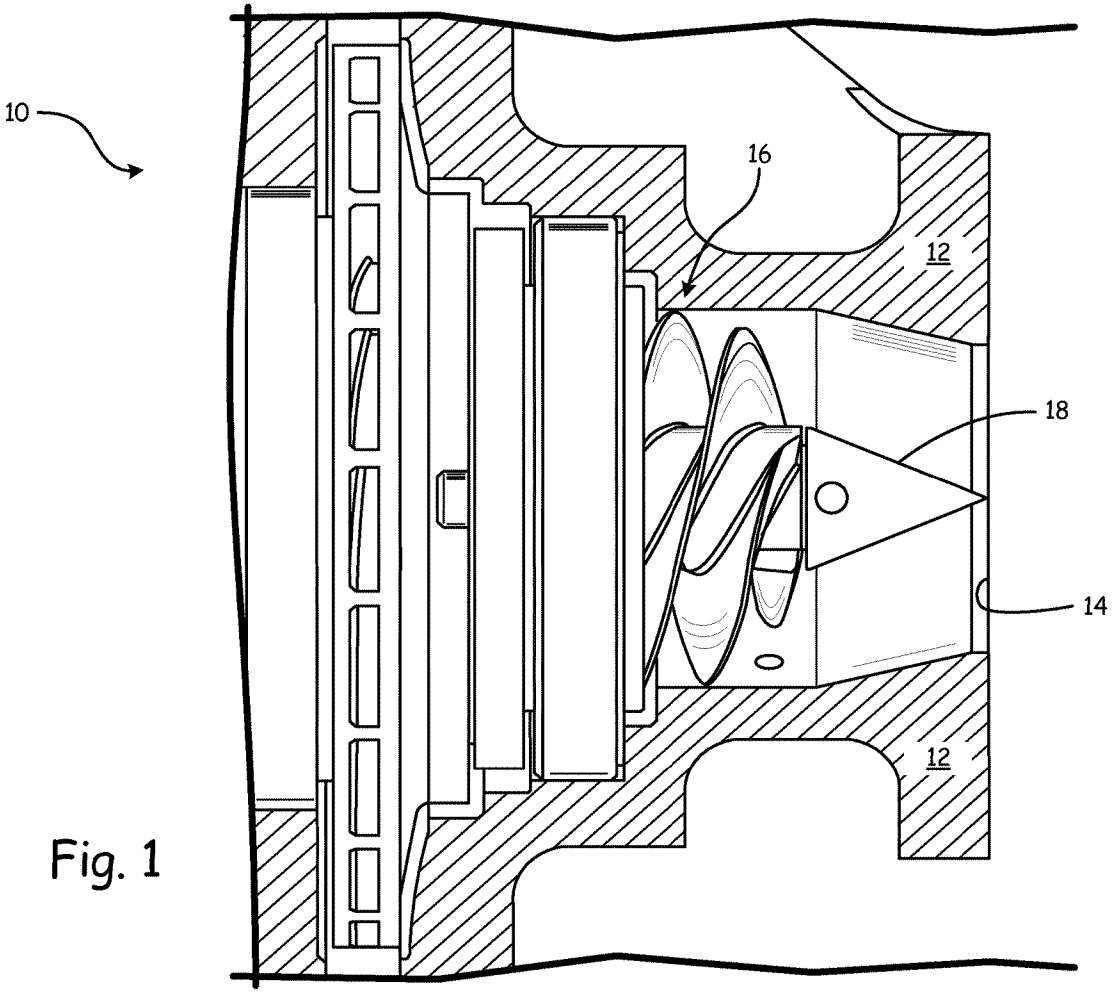
FIG. 1 is a partial section view of an inlet of a fuel pump with an impeller spinner, wherein a portion of the housing has been omitted.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

An impeller spinner can be attached to an inlet of a fuel pump to deflect a flow of liquid fuel and reduce the size of a zone of low flow or stagnation at the inlet, thereby limiting ice accretion at the inlet and ingestion by the impeller.

FIG. 1 is a partial section view centrifugal fuel pump 10 having housing 12, inlet 14, impeller 16, and impeller spinner 18. A portion of housing 12 has been omitted (i.e., shown in section) to reveal impeller 16 and impeller spinner 18. The use of impeller spinner 18 is not limited to the embodiment shown. It will be understood by one skilled in the art that impeller spinner 18 can be used in a variety of pumps to limit or prevent ice accretion by reducing the size of a stagnation zone at an impeller inlet. In the embodiment shown in FIG. 1, impeller spinner 18 has a conical structure that extends axially outward from impeller 16 to an outer edge of impeller inlet 14.

During operation of fuel pump 10, impeller 16 rotates and draws fuel from a fuel line (not shown) into inlet 14 and impeller 16. In the absence of impeller spinner 18, a volume of low flow forms near a center position within inlet 14 at an end of impeller 16. Generally, velocities less than 1 foot per second (0.3 meters per second) in the embodiment shown pose risk for ice formation. Ice that forms can collect on the end of impeller 16, forming a snowball-like cluster, which can break free and enter impeller 16. While ingestion of small amounts of ice can be tolerated, ingestion of large clusters of ice can create a risk of blocking fluid flow. Impeller spinner 18 can deflect fluid flow around the end of impeller 16 and reduce a volume of low flow forward of impeller 16. Reducing the volume of the stagnation zone can limit or prevent the formation of larger snowball-like clusters of ice. Small amounts of ice that may form can be ingested by impeller 16 without blocking flow.

Figure 2:
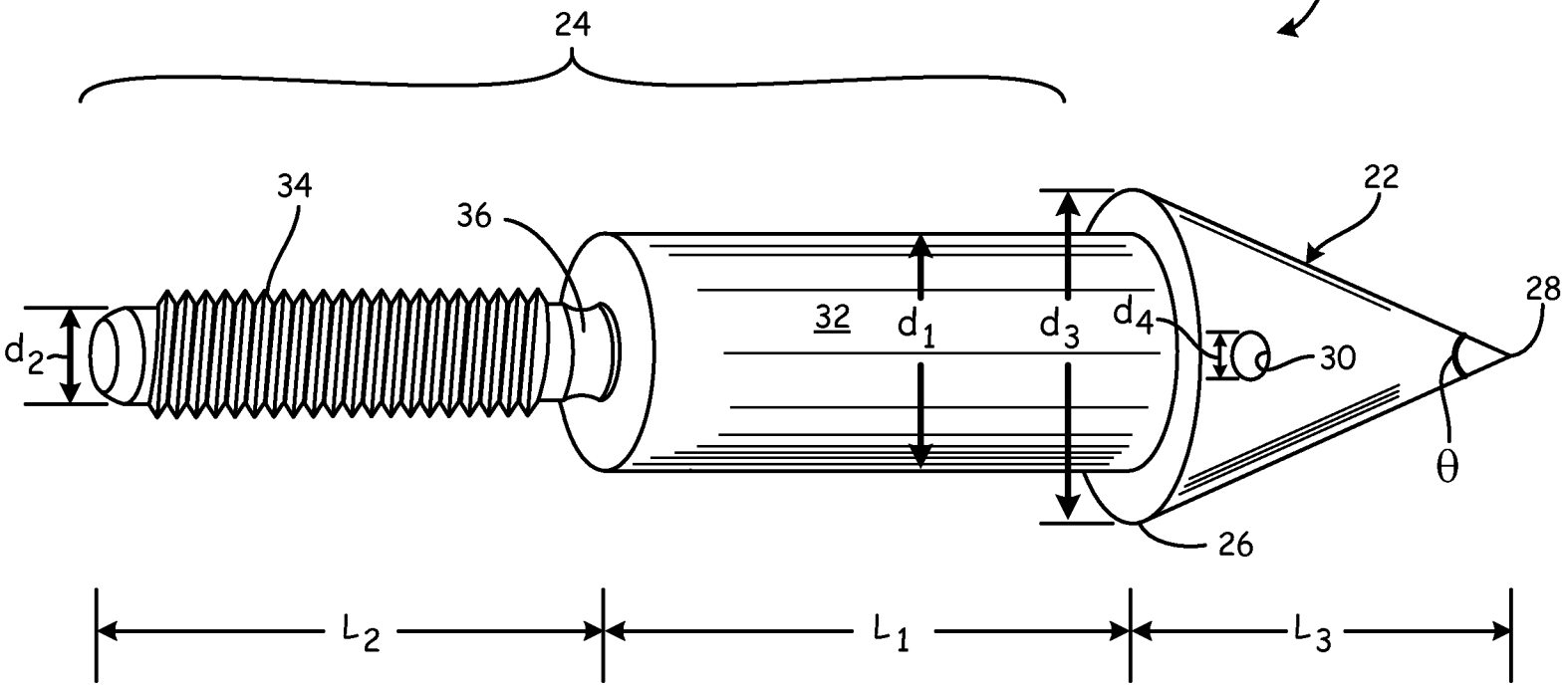
FIG. 2 is a perspective view of the impeller spinner.
Figure 3:
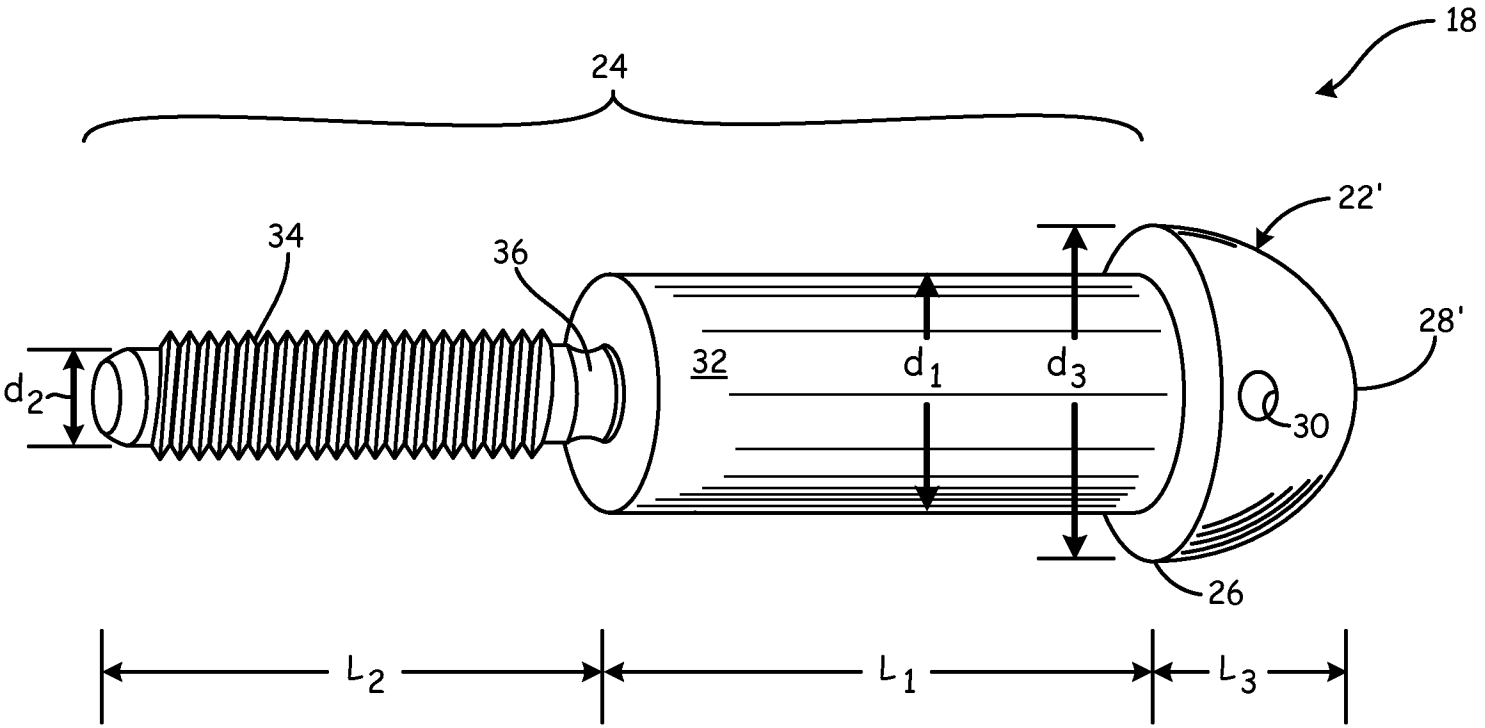
FIG. 3 is a perspective view of another embodiment of the impeller spinner.
Figure 4:
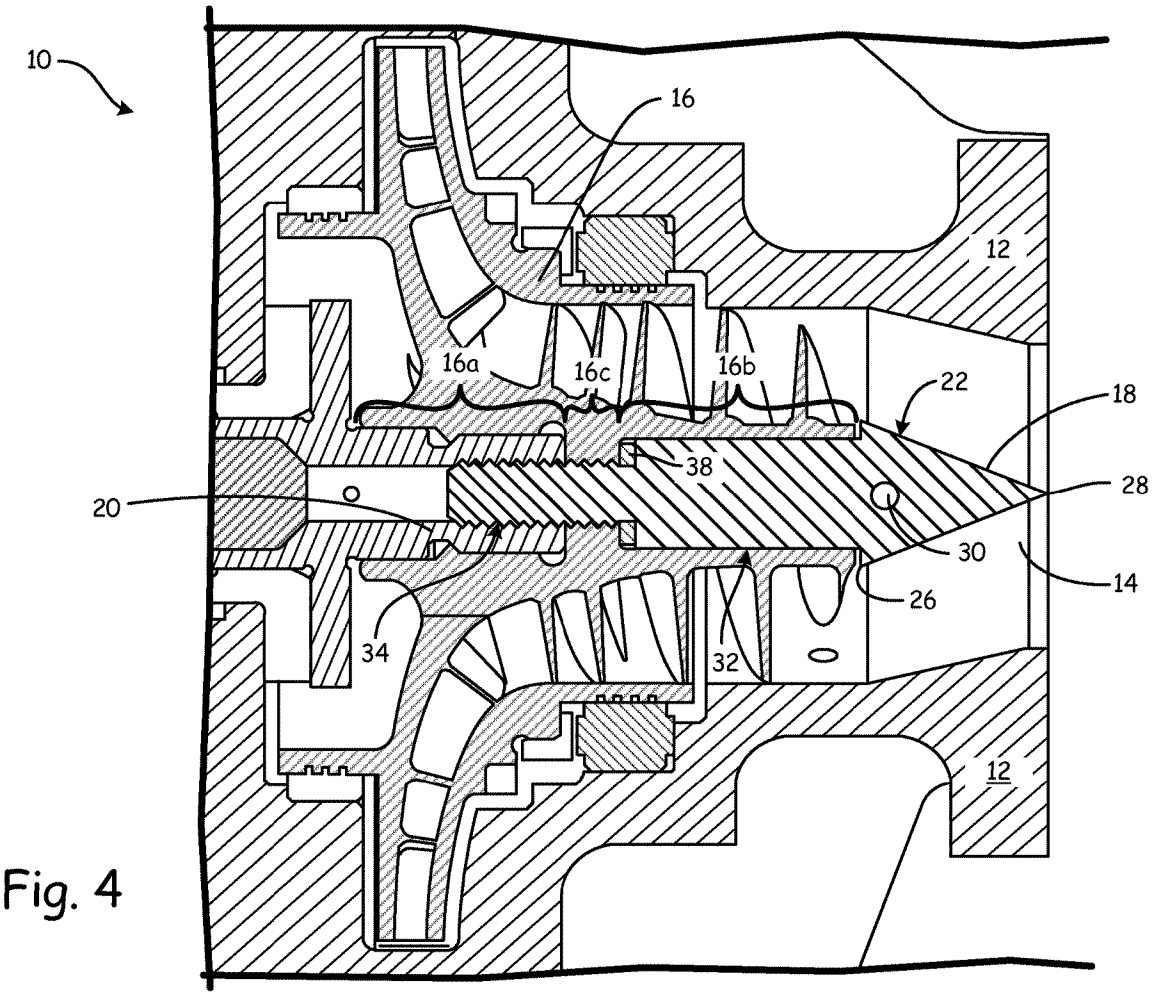
FIG. 4 is a cross-sectional view of FIG. 1.

FIGS. 2 and 3 provide a perspective view of two different embodiments of impeller spinner 18. FIG. 4 shows a cross-sectional view of impeller spinner 18 as embodied in FIG. 2 mounted in fuel pump 10. Impeller spinner 18 can serve dual purposes. Impeller spinner 18 can function as a fastening mechanism for retaining impeller 16 on rotor 20 and as an anti-icing apparatus for limiting ice accretion at impeller inlet 14.

Impeller spinner 18, as shown in FIGS. 2-4 can include head 22 and shank 24. Head 22 and shank 24 can be of integral and monolithic construction. Head 22 can include base 26, tip 28, and hole 30. Shank 24 can include body 32 and fastener section 34. The construction of impeller 18 can be defined by the dimensions and features of impeller 16, rotor 20, and housing 12 (shown in FIG. 4).

Body 32 and fastener section 34 can be cylindrical in shape to substantially match cylindrical shafts extending through impeller 16 and rotor 20. The outer diameter $d_1$ (see FIGS. 2 and 3) of body 32 can be greater than the outer diameter $d_2$ (outer diameter without threads, see FIGS. 2 and 3) of fastener section 34 to substantially match inner diameters of impeller 16 and rotor 20 (shown in FIG. 4), respectively. As shown in FIG. 4, impeller 16 can have a first section 16*a* with an inner radial surface engaged with an outer radial surface of rotor 20, a second section 16*b* with an inner radial surface adjacent to an outer radial surface of body 32, and a third section 16*c* with an inner radial surface adjacent to an outer radial surface of fastener section 34. The third section 16*c* can axially abut rotor 20 on one side and body 32 on an opposite side. Alternatively, the third section 16*c* can abut washer 38 on an opposite side when washer 38 is positioned between the third section 16*c* and body 32. Base 26 can be substantially flat and circular to match the shape of body 32 and the end of impeller 16. Base 26 can have a diameter $d_3$ (see FIGS. 2 and 3) that is greater than the outer diameter $d_1$ of body 32 such that base 26 can axially engage the end of impeller 16. Diameter $d_3$ can substantially match an inner diameter of impeller 16's flow surface. Base 26 and the end of impeller 16 can be separated axially by a gap to allow for thermal expansion of impeller 16 toward base 26 during operation of fuel pump 10. Body 32 can have a length $L_1$ that substantially matches a distance between third section 16*c* and the end of impeller 16, less a thickness of washer 38, if washer 38 is used. Fastener section 34 can have a length $L_2$ sufficient to extend into the shaft of rotor 20 as needed to secure impeller spinner 18 to rotor 20. Fastener section 34 can be threaded to fit a threaded inner radial surface of rotor 20 (not shown) to provide secure attachment. Body 32 can serve as a pilot feature to help align threads during assembly. Alternatively, an adhesive, bolt, or other suitable fastening mechanism can be used to secure impeller spinner 18 in place. Fastener section 34 can further include neck 36 of reduced diameter positioned adjacent an end of fastener section 34 where fastener section 34 joins body 32. Neck 36 is a safeguard designed to break to protect other components in the event too much torque is applied. In the embodiments shown in FIGS. 2 and 3, the length $L_1$ of body 32 is approximately 1.2 times the length $L_2$ of fastener section 34. However, it will be understood by one skilled in the art that the dimensions of impeller spinner 18 can be modified as needed for varying applications.

Hole 30 (see FIGS. 2-4) can extend through head 22 such that hole 30 traverses a cross-section of head 22 at a location between base 26 and tip 28. Hole 30 can extend through a centerline axis extending from tip 28 through shank 24. Hole 30 can be configured to accept a through-pin (not shown), which can be inserted during assembly to tighten or screw impeller spinner 18 into rotor 20. The through-pin can be removed prior to operation of fuel pump 10. Hole 30 can be positioned nearer base 26 than tip 28 to limit any negative impact hole 30 can have on fluid flow at inlet 14. In the embodiments shown in FIGS. 2-4, an outer diameter $d_4$ (shown in FIG. 2) of hole 30 is approximately 0.125 inches, however, it will be understood by one skilled in the art that the size of hole 30 can be modified to accommodate varying applications. For instance, through-pins with larger diameters can be used with larger impeller spinners requiring greater torque for assembly. In general, the size of hole 30 can be minimized to limit negative impact on both the fluid flow and the structural integrity of impeller spinner 18. An optimal size of hole 30 can generally be determined by considering the allowable material stresses when applying torque.

Impeller spinner 18 is generally suited to small pumps in which a single bolt is capable of fixing an impeller to a rotor. In the embodiments shown, impeller spinner 18 is approximately two inches (five centimeters) in length, however, impeller spinner 18 could be scaled up or down to accommodate different applications. Scaling does not require that the parts of impeller spinner 18 (head 22, body 32, and fastener section 34) maintain a fixed ratio. The dimensions of impeller spinner 18 can be modified to accommodate varying sizes of pumps. Fan spinners and nose cones commonly used on gas turbine engines generally utilize multiple fastening mechanisms and attachment locations and could not be directly adapted for the disclosed use.

The primary purpose of impeller spinner 18 is to function as an anti-icing apparatus. Impeller spinner 18 can deflect a fluid flow and reduce the size or volume of the stagnation or low flow zone at inlet 14, and thereby limit the rate of ice accretion and ingestion by impeller 16. Head 22 can be configured to deflect fluid flow. As shown in FIGS. 2-4, head 22 can extend outward from the end of impeller 16 into a fluid flow path. Head 22 can have a substantially conical shape, as shown in FIG. 2 or, alternatively, can have a substantially rounded shape, as shown in FIG. 3. In general, head 22 can be axisymmetric with a substantially smooth surface. In alternative embodiments (not shown), a stepped tapering of head 22 can be used; however, such stepped tapering may be less effective and can have the potential to create smaller zones of stagnation.

The conical shape of head 22 shown in FIG. 2 can extend from base 26 to tip 28. Head 22 can extend toward impeller inlet 14 (shown in FIG. 4). Preferably, head 22 extends to the outer edge of impeller inlet 14. In general, extending tip 28 to the outer edge of impeller inlet 14, as opposed to a position nearer the end of impeller 16, can more effectively reduce the size of the stagnation zone at inlet 14 and thereby more effectively limit ice accretion. In the embodiment shown in FIGS. 2 and 4, tip 28 can have an apex angle θ of approximately 40 degrees when head 22 extends fully to the outer edge of impeller inlet 14, as shown in FIG. 4. However, the apex angle of tip 28 can vary widely from one application to another depending on the distance between the end of impeller 16 and impeller inlet 14. In general, tip 28 can be sharply pointed as shown in FIGS. 2 and 4 to efficiently deflect fluid flow; however, a moderately pointed tip (not shown, but having a structure in between that shown in FIGS. 2 and 3) can also be used. Tip 28 can also be very narrowly rounded to remove a sharp point, which can cause injury upon assembly. In the embodiment shown, head 22 can generally have a length $L_3$ that is 25 to 35 percent of a total length ($L_1+L_2\pm L_3$) of impeller spinner 18 with a preferable length nearing 30 percent when head 22 extends fully to the outer edge of impeller inlet 14. As previously discussed, it will be understood by one skilled in the art that all dimensions of impeller spinner 18, including the apex angle θ, lengths $L_1$, $L_2$, and $L_3$, *and* diameters $d_1$, $d_2$, $d_2$, and $d_4$, including their relationship to one another, can be modified to accommodate varying applications.

The rounded shape of head 22' shown in FIG. 3 can be substantially hemispherical or can have a substantially conical shape similar to the embodiment shown in FIG. 2 with broadly rounded tip 28'. The position and dimensions of hole 30 can substantially match the position and dimensions of hole 30 in the embodiment shown in FIG. 2. In general, the length $L_3$ of head 22' shown in FIG. 3 will be less than the length $L_3$ of head 22 shown in FIG. 2 and head 22' will not fully extend to the outer edge of inlet 14. However, in further embodiments not illustrated, head 22' can be elongated to reach or more nearly reach the outer edge of inlet 14.

In the absence of impeller spinner 18, a volume of low flow forms near a center position at inlet 14 toward impeller 16. Ice that forms can collect on the end of impeller 16, forming a snowball-like cluster, which can break free and enter impeller 16. While ingestion of small amounts of ice can be tolerated, ingestion of large clusters of ice can block fluid flow. Both the conical shaped impeller spinner 18 shown in FIG. 2 and the rounded shaped impeller spinner 18 shown in FIG. 3 can deflect fluid flow near inlet 14 and reduce a volume of low flow in front of impeller 16. Reducing the volume of the stagnation zone can limit or prevent the formation of larger snowball-like clusters of ice. Small amounts of ice that may form can be ingested by impeller 16 without blocking fluid flow.

Discussion of Possible Embodiments

The following are non-exclusive descriptions of possible embodiments of the present invention.

An impeller spinner for a fuel pump can include a head and a shank. The head can have a base at one end and a tip at an opposite end. The shank can have a body portion nearest the head with a first diameter and a fastener portion adjacent to the body portion at an end opposite the head with a second diameter.

The impeller spinner of the preceding paragraph can optionally include, additionally and/or alternatively, any one or more of the following features, configurations and/or additional components:

A further embodiment of the foregoing impeller spinner, wherein the head can have a conical shape.

A further embodiment of the foregoing impeller spinner, wherein the tip of the head can be substantially pointed.

A further embodiment of the foregoing impeller spinner, wherein the tip of the head can be rounded.

A further embodiment of the foregoing impeller spinner, wherein a hole can extend through the head such that the hole traverses a cross-section of the head at a location between the base and the tip and is configured to accept a pin.

A further embodiment of the foregoing impeller spinner, wherein a distance between the base and hole can be less than a distance between the hole and the tip.

A further embodiment of the foregoing impeller spinner, wherein the head can be axisymmetric and can have a substantially smooth surface.

A further embodiment of the foregoing impeller spinner, wherein the fastener portion of the shank can be threaded and the first diameter can be greater than the second diameter and less than a diameter of the base of the head.

An anti-icing apparatus for a fuel pump can include an impeller spinner. The impeller spinner can include a head and a shank. The head can have a base at one end and a tip at an opposite end. The shank can have a body portion nearest the base of the head with a first diameter and a fastener portion adjacent to the body portion at an end opposite the head with a second diameter. The first diameter can be greater than the second diameter and less than a diameter of the base of the head.

The anti-icing apparatus of the preceding paragraph can optionally include, additionally and/or alternatively, any one or more of the following features, configurations and/or additional components:

A further embodiment of the foregoing anti-icing apparatus, wherein the anti-icing apparatus can further include a rotor shaft, an impeller, and a housing. The impeller can have a first and a second section each having an inner radial surface. A portion of the first inner radial surface can be engaged with an outer radial surface of the rotor shaft. The housing can substantially surround the impeller and have an inlet. The shank can extend into both the impeller and a bore of the rotor shaft, such that the body portion is adjacent to the inner radial surface of the second section of the impeller, the fastener portion is engaged with an inner radial surface of the rotor shaft, and the head extends axially outward from an end of the second section of the impeller toward the inlet of the housing.

A further embodiment of the foregoing anti-icing apparatus, wherein the base of the head and the end of the impeller can be separated axially by a gap.

A further embodiment of the foregoing anti-icing apparatus, wherein the head can have a conical shape and the tip of the head can be substantially pointed.

A further embodiment of the foregoing anti-icing apparatus, wherein the tip of the head can extend substantially to an outer edge of the impeller inlet A further embodiment of the foregoing anti-icing apparatus, wherein the tip of the head can be rounded.

A further embodiment of the foregoing anti-icing apparatus, wherein a hole can extend through the head such that the hole traverses a cross-section of the head at a location between the base and the tip and is configured to accept a pin.

A further embodiment of the foregoing anti-icing apparatus, wherein a distance between the base and hole can be less than a distance between the hole and the tip.

A further embodiment of the foregoing anti-icing apparatus, wherein the body portion of the shank can axially engage a portion of the impeller and/or a washer positioned between the impeller and the body portion, and wherein the fastener portion of the impeller spinner can be threadedly engaged with the inner radial surface of the rotor shaft.

A further embodiment of the foregoing anti-icing apparatus, wherein the impeller further includes a third section. The third section can axially engage the rotor shaft and can have an inner radial surface adjacent to the fastener portion of the impeller spinner.

A method of reducing ice accretion on an impeller of a centrifugal fuel pump can include rotating an impeller of the centrifugal fuel pump and deflecting a flow of fuel upstream of the impeller. The flow of fuel can be deflected by a conical structure having a base engaged with the impeller and a pointed tip upstream of the impeller.

The method of the preceding paragraph can optionally include, additionally and/or alternatively, any one or more of the following features, configurations and/or additional components:

A further embodiment of the foregoing method, wherein the tip of the conical structure extends substantially to an outer edge of a housing of the centrifugal pump.

SUMMATION

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An anti-icing apparatus for a fuel pump comprises:

an impeller spinner comprising:

a head having a base at one end and a tip at an opposite end; and a shank having:

a body portion nearest the base of the head, wherein the body portion has a first diameter that is less than a diameter of the base of the head and has an end surface opposite the base of the head, wherein the end surface is in a radial plane; and a fastener portion adjacent to the body portion end surface, wherein the fastener portion has a second diameter that is less than the first diameter;

a rotor shaft;

an impeller having a first section having a first inner radial surface and a second section having a second inner radial surface, wherein a portion of the first inner radial surface is engaged with an outer radial surface of the rotor shaft; and a housing substantially surrounding the impeller and having an inlet;

wherein the shank extends into both the impeller and a bore of the rotor shaft, such that the body portion is adjacent to the second inner radial surface, the fastener portion is engaged with an inner radial surface of the rotor shaft, and the head extends axially outward from an end of the second section of the impeller toward the inlet of the housing.

2. The anti-icing apparatus of claim 1, wherein the base of the head and the end of the second section of the impeller are separated axially by a gap.

3. The anti-icing apparatus of claim 2, wherein the head has a conical shape and the tip of the head is substantially pointed.

4. The anti-icing apparatus of claim 1, wherein the tip of the head extends substantially to an outer edge of the housing inlet.

5. The anti-icing apparatus of claim 1, wherein the tip of the head is rounded.

6. The anti-icing apparatus of claim 1, wherein a hole extends through the head such that the hole traverses a cross-section of the head at a location between the base and the tip and is configured to accept a pin.

7. The anti-icing apparatus of claim 6, wherein a distance between the base and hole is less than a distance between the hole and the tip.

8. The anti-icing apparatus of claim 1, wherein the end surface of the body portion axially abuts at least one surface in a radial plane selected from the group consisting of a surface of the impeller oriented in a radial plane and a surface of a washer positioned between the impeller and the end surface of the body portion, and wherein the fastener portion of the impeller spinner is threadedly engaged with the inner radial surface of the rotor shaft.

9. The anti-icing apparatus of 1, wherein the impeller further comprises:

a third section having a surface in a radial plane that abuts an end surface of the rotor shaft and has a third inner radial surface adjacent to the fastener portion of the impeller spinner.

10. A method of reducing ice accretion on an impeller of a centrifugal fuel pump, the method comprising the steps of:

rotating an impeller of the centrifugal fuel pump;

rotating an impeller spinner, the impeller spinner comprising:

a head having a base at one end and a tip at an opposite end; and a shank having a body portion nearest the head, wherein the body portion has a first diameter that is less than a diameter of the base of the head and has an end surface opposite the base of the head, wherein the end surface is in a radial plane; and a fastener portion adjacent to the body portion end surface, wherein the fastener portion has a second diameter that is less than the first diameter;

axially abutting a first impeller surface in a radial plane with a surface of a rotor shaft;

axially abutting a second impeller surface in a radial plane with the end surface of the body portion of the shank or a washer disposed between the second impeller surface and the body portion; and deflecting a flow of fuel upstream of the impeller, wherein the flow of fuel is deflected by the tip of the impeller spinner.

11. The method of claim 10, wherein the tip of the head of the impeller spinner extends substantially to an outer edge of a housing of the centrifugal pump.

* * * * *